US009506252B2

(12) United States Patent
Molteni

(10) Patent No.: US 9,506,252 B2
(45) Date of Patent: Nov. 29, 2016

(54) EXTRUDED PROFILE FOR A FITTED PANEL AND FITTED PANEL COMPRISING SAID EXTRUDED PROFILE

(71) Applicant: UNIFOR S.P.A., Como (IT)

(72) Inventor: Piero Molteni, Como (IT)

(73) Assignee: UNIFOR S.p.A., Como Turate (IT)

( * ) Notice: Subject to any disclaimer, the term of this patent is extended or adjusted under 35 U.S.C. 154(b) by 0 days.

(21) Appl. No.: 14/813,447

(22) Filed: Jul. 30, 2015

(65) Prior Publication Data

US 2016/0040434 A1 Feb. 11, 2016

(30) Foreign Application Priority Data

Aug. 7, 2014 (IT) ..... MI2014A1462

(51) Int. Cl.

| | |
|---|---|
| ***E04B 2/00*** | (2006.01) |
| ***E04F 13/08*** | (2006.01) |
| ***A47F 5/08*** | (2006.01) |
| ***A47B 96/06*** | (2006.01) |
| ***E04B 1/41*** | (2006.01) |

(52) U.S. Cl.

CPC ..... *E04F 13/0828* (2013.01); *A47B 96/067* (2013.01); *A47F 5/0846* (2013.01); *E04B 1/40* (2013.01)

(58) Field of Classification Search

CPC .... E04F 13/0828; E04B 1/40; A47B 96/067; A47F 5/0846

USPC ..... 52/483.1, 302.1, 506.06, 513

See application file for complete search history.

(56) References Cited

U.S. PATENT DOCUMENTS

| | | | | | |
|---|---|---|---|---|---|
| 3,950,049 | A * | 4/1976 | Drass | A47B 95/008 | 312/198 |
| 4,660,339 | A * | 4/1987 | Paz | E04F 13/0803 | 52/238.1 |
| 4,765,111 | A * | 8/1988 | Osawa | E04F 13/0826 | 52/235 |
| 4,809,479 | A * | 3/1989 | Tierno | E04F 13/0864 | 211/189 |
| 4,866,896 | A * | 9/1989 | Shreiner | E04F 13/081 | 52/235 |
| 5,301,484 | A * | 4/1994 | Jansson | E04F 13/145 | 52/122.1 |

(Continued)

FOREIGN PATENT DOCUMENTS

| | | |
|---|---|---|
| DE | 29903019 | 4/1976 |
| DE | 29609015 | 8/1996 |
| EP | 1082923 | 3/2001 |

OTHER PUBLICATIONS

International Search Report; Apr. 21, 2015; The Hague; Application IT MI20141462; 7 pages.

*Primary Examiner* — Basil Katcheves
*Assistant Examiner* — Joshua Ihezie
(74) *Attorney, Agent, or Firm* — Thomas Horstemeyer, LLP

(57) ABSTRACT

An extruded connection profile for connecting to each other an upper portion and a lower portion of a fitted panel adapted to be hung to a wall and comprising a panel slot for receiving and hooking an object hung on said panel, a coupling portion which extends transversely from said abutment surface, and an anchoring rib (20) for hanging the panel (1) to a wall. The invention also relates to a fitted panel comprising such an extruded profile.

16 Claims, 4 Drawing Sheets

(56) References Cited

U.S. PATENT DOCUMENTS 5,412,912 A * 5/1995 Alves ..... A47F 5/0846 211/94.01
5,598,671 A * 2/1997 Ting ..... E06B 7/14 52/234
6,170,214 B1 * 1/2001 Treister ..... E04F 13/0808 52/235
6,289,646 B1 * 9/2001 Watanabe ..... E04F 13/083 52/235
6,430,883 B1 * 8/2002 Paz ..... A47F 5/105 52/235
7,043,884 B2 * 5/2006 Moreno ..... E04F 13/0808 52/235
7,207,147 B2 * 4/2007 Price ..... E04B 2/06 52/574
7,596,911 B2 * 10/2009 Turco ..... E04F 19/062 52/127.6
7,726,083 B2 * 6/2010 Wagner ..... E04F 13/0812 52/235
7,849,651 B2 * 12/2010 Fujito ..... E04F 13/0803 248/216.1
8,033,066 B2 * 10/2011 Griffiths ..... E04F 13/081 52/235
8,051,623 B2 * 11/2011 Loyd ..... E04F 13/0803 52/235
8,769,901 B2 * 7/2014 Todd ..... E04F 13/0805 52/302.1
8,839,582 B2 * 9/2014 Aboukhalil ..... E04F 19/022 52/460
9,080,331 B2 * 7/2015 Aboukhalil ..... E04F 13/0816
9,091,079 B2 * 7/2015 Wright ..... E04F 13/0816
2007/0221594 A1 * 9/2007 Pierro ..... A47F 5/0846 211/94.01
2008/0134594 A1 * 6/2008 Ness ..... E04F 13/0889 52/200
2012/0073233 A1 * 3/2012 Harrington ..... E04B 2/72 52/582.1
2012/0198788 A1 * 8/2012 MacDonald ..... E04F 13/0825 52/747.1
2012/0273633 A1 * 11/2012 Henriott ..... A47B 96/067 248/205.1

* cited by examiner

EXTRUDED PROFILE FOR A FITTED PANEL AND FITTED PANEL COMPRISING SAID EXTRUDED PROFILE

CROSS-REFERENCE TO RELATED APPLICATION

This application claims the benefit of an priority to Italian patent application number MI2014A001462, filed on Aug. 7, 2014, the entirety of which is hereby incorporated by reference.

FIELD OF THE INVENTION

The present invention relates to the industrial field of furnishing, and in particular it relates to an extruded profile for connecting to each other two adjacent portions of a fitted panel adapted to be hung to a wall. The fitted panel has at least one horizontal slot for engaging a bracket for supporting other components, such as a horizontal shelf or a cabinet. The present invention also relates to a fitted panel comprising such a profile.

BACKGROUND ART

Connecting devices between an upper board and a lower board are known, to achieve a partition modular wall to separate one area from another.

Each board is therefore placed on a lower board, and sometimes it is fixed to the lower board. Each board bears the weight of all the boards above.

Sometimes, one or more extruded profiles fixed by screws to the upper board and to the lower board are used, further comprising a groove adapted to allow the hooking of objects projecting from the partition wall.

Such known walls are accessible from both sides and therefore, for aesthetic reasons, the connection profiles must be as little as possible visible from both sides of the wall.

Among other things, the static load on each board is given by the weight of the upper boards and of the other components supported resting thereon.

These structures are thus designed to support compressive loads.

A known device of this type for connecting an upper board to a lower board of a wall resting on a floor involves the use of two separate profiled elements coupled together, fixed to two facing sides of a lower board and an adjacent upper board, respectively. These two elements may include complementary surfaces to align such boards when they are resting on one another.

Sometimes, however, the need is felt to have a fitted panel to be applied hung to a wall, able to allow the engagement to such a panel of cantilever shelves, or other hanging components, positionable in different positions along a horizontal line, or to be able to slide such components horizontally along the wall.

The known structures do not allow being hung to an existing wall as they would tend to break down into individual boards since the profiles used are able to resist compressive and not tensile stresses.

For example, if an upper board of a known panel as described above were fixed to the wall, all the other lower boards would be hanging on such an upper board and the weight of the same and of the wall units hanging on the panel would weigh thereon. This would cause the separation of the boards of the above described known panels, since the profiles typically used would not withstand such a high tensile stress.

Moreover, the known structures cannot be hung to an existing wall since they would not be able to withstand the applied loads without deformation on the joints between the boards. In fact, such structures, when hung, would be subjected to a stress distribution different from when they are resting on a floor, and would inevitably tend to assume a deformed configuration not suited to their function.

More in detail, it may happen that the application of cantilever loads generates forces torques with respect to the fixing points of such structures to a wall, which inevitably would cause the deformation of the structure itself at the joints between the boards.

Therefore, the need is felt to provide an extruded connection profile for connecting to each other an upper portion and a lower portion of a fitted panel having hooking slots for support brackets, able to allow the hooking of such a panel to a wall in a hanging manner while preventing such a panel from getting deformed under the action of forces applied to the same at the slots, and preventing such a panel from being broken down due to its own weight and to the weight applied by hanging cupboards suspended on the panel.

The need is also felt to provide such a fitted panel adapted to be hung to a wall preventing the deformation under the action of loads.

SUMMARY OF THE INVENTION

The object of the present invention is to devise and provide an extruded connection profile for connecting to each other a lower portion and an upper portion of a fitted panel adapted to be hung to a wall, which allows satisfying the above requirements and obviating at least partially the drawbacks mentioned above with reference to the prior art.

In particular, the object of the present invention is to provide a fitted panel comprising a panel slot adapted to engage and support a support bracket for a hung component, wherein such a panel is able to be hung preventing the deformation under the action of the loads hanging from the panel.

These and further objects are achieved by an extruded connection profile connecting to each other an upper portion and a lower portion of a fitted panel according to claim 1, as well as by a fitted panel comprising such a profile.

According to a general embodiment, an extruded connection profile for connecting to each other an upper portion and a lower portion of a fitted panel adapted to be hung to a wall and comprising a panel slot, said profile defining a longitudinal direction (L-L), comprises a plate portion delimited by an abutment surface and by an upper edge parallel to the longitudinal direction and by a lower edge parallel to the upper edge; a coupling portion which extends transversely from said abutment surface, said coupling portion comprising a longitudinal channel laterally delimited by at least one lip undercut which projects inwardly of the longitudinal channel; an anchoring rib for suspending the panel to a wall, said rib extending transversely from said plate portion, on the side opposite to said engagement portion.

Advantageously, the anchoring rib for suspending the panel to a wall, which is part of the extruded profile, is arranged on the side opposite to the coupling portion, in relation to the plate.

Schematizing the forces applied, in use, to the fitted panel, it is noted that a load torque is applied on the profile by the weight on the shelf, or other component engaged cantilevering to the profile through the longitudinal channel. Such a load torque would tend to make the profile rotate about the longitudinal axis in a clockwise direction with respect to the suspension point on the wall. This rotation is prevented by the presence of the anchoring rib, which is arranged on the side opposite to the channel and is made in one piece with the profile.

The force applied to the profile at the channel on one side of the plate portion is thus balanced by the reaction applied to the anchoring rib on the opposite side of the plate.

The plate portion is configured to be placed in abutment against, and fixed to the rear side of an upper portion of the panel and the rear side of an adjacent lower portion of the panel. This means that when the profile is fixed to the upper portion of the panel and to the lower portion of the panel, the plate portion, which is made in a single piece, connects with continuity the upper portion of the panel and the lower portion of the panel, thus effectively opposing the tendency of the profile to rotate about its extrusion axis when urged by the projecting weight applied to the coupling portion. In other words, such a plate portion provides high solidity of the fitted panel, able to oppose the stress of the projecting weight applied to the profile.

Moreover, the plate portion is fixed to the rear side of the panel, contributing to greater structural solidity of the fitted panel, giving a high tensile strength to the panel structure which allows it to be hung and to withstand high loads, avoiding breaking down.

BRIEF DESCRIPTION OF THE FIGURES

Various embodiments of the invention are described hereafter through embodiment examples given only as a non-limiting indication with reference in particular to the accompanying figures, in which.

DESCRIPTION OF SOME PREFERRED EMBODIMENT EXAMPLES

Figure 1:
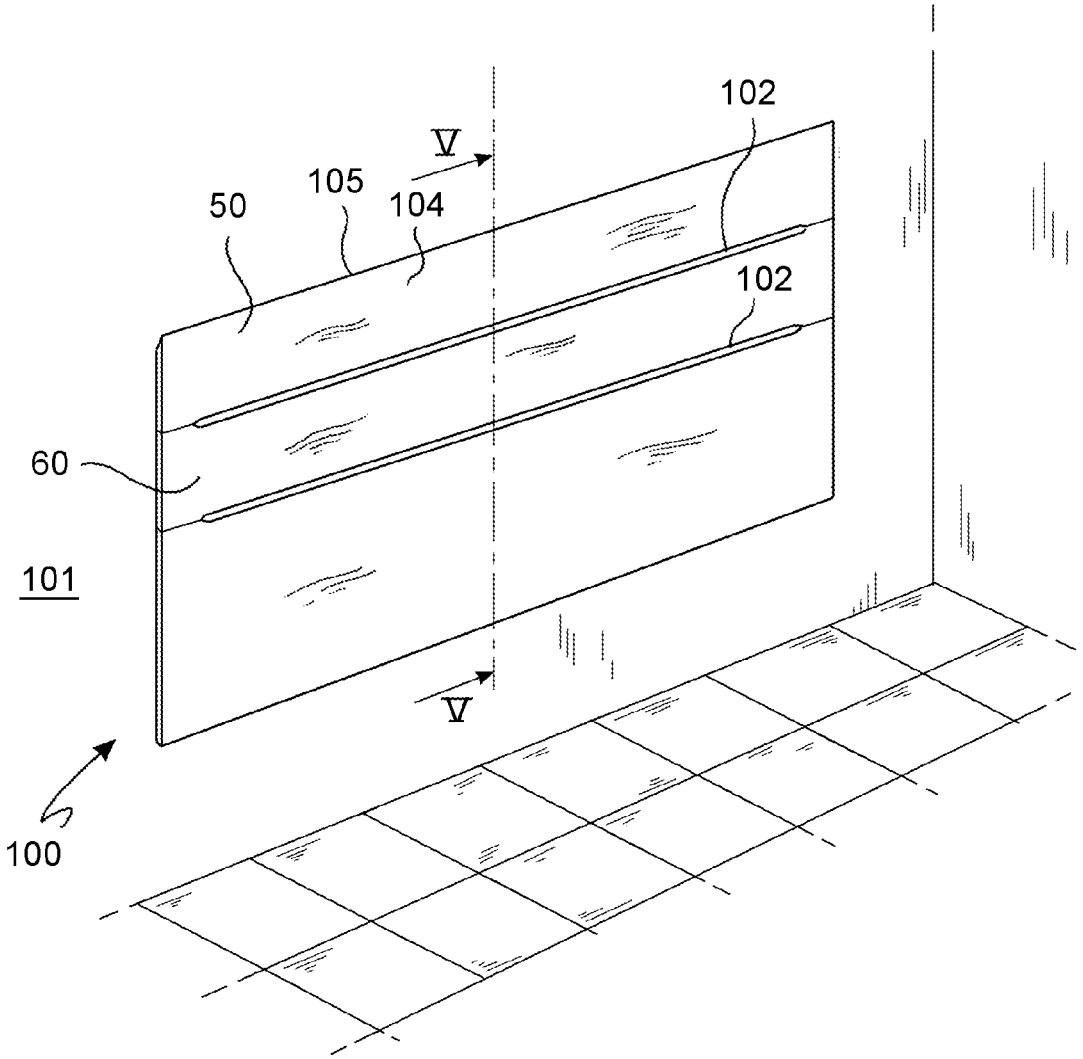
FIG. 1 shows a perspective view of a fitted panel according to the invention applied hung to a wall of a room.
Figure 2:
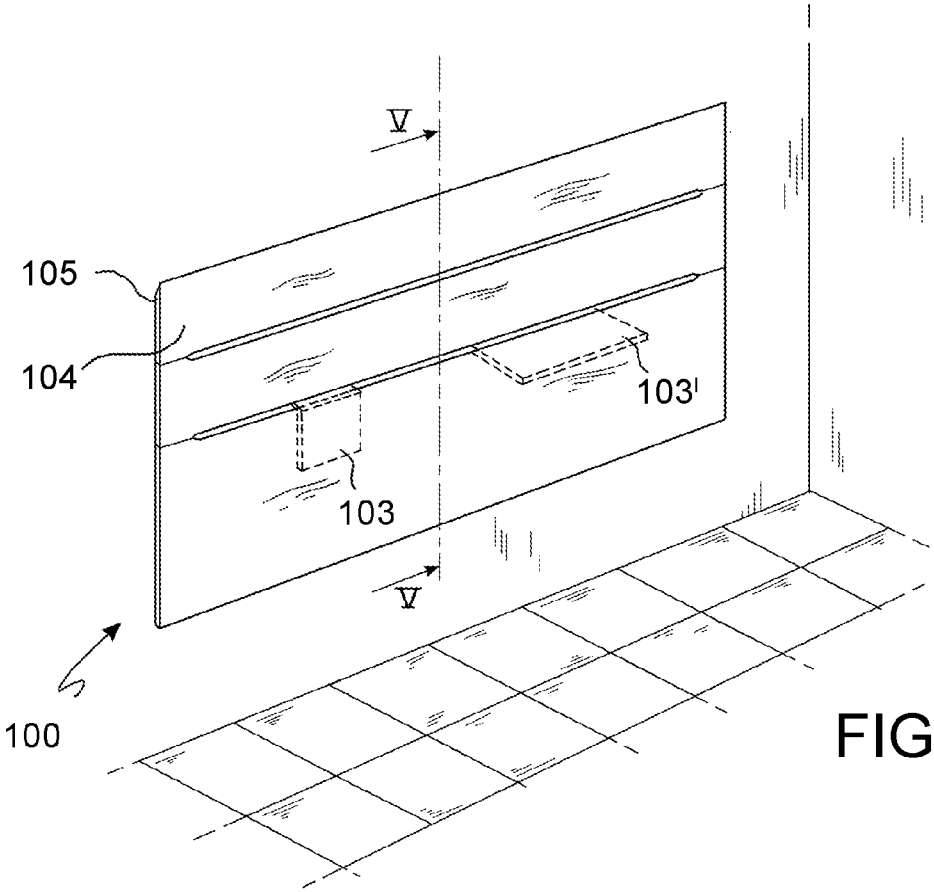
FIG. 2 shows the perspective view of FIG. 1 in which a portion of shelf or a bracket engaged in a panel slot are represented with a dashed line.
Figure 3:
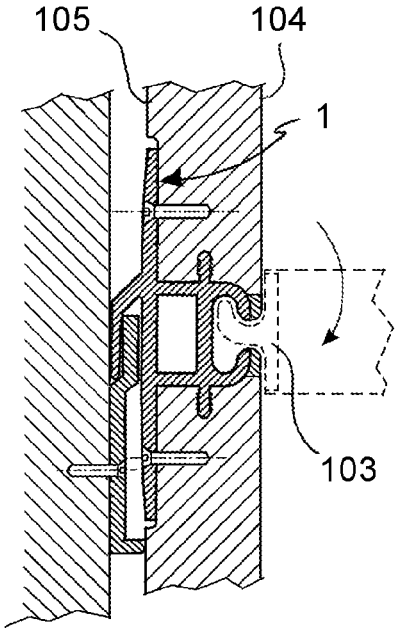
FIGS. 3 and 4 show an example of a portion of a fitted panel applied to a wall, in which a shelf and a cabinet are schematically shown, respectively, with a dashed line.
Figure 4:
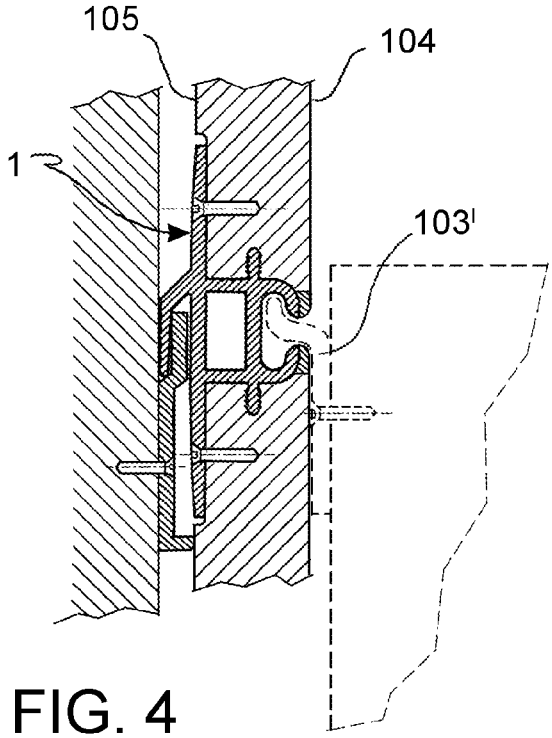
Figure 5:
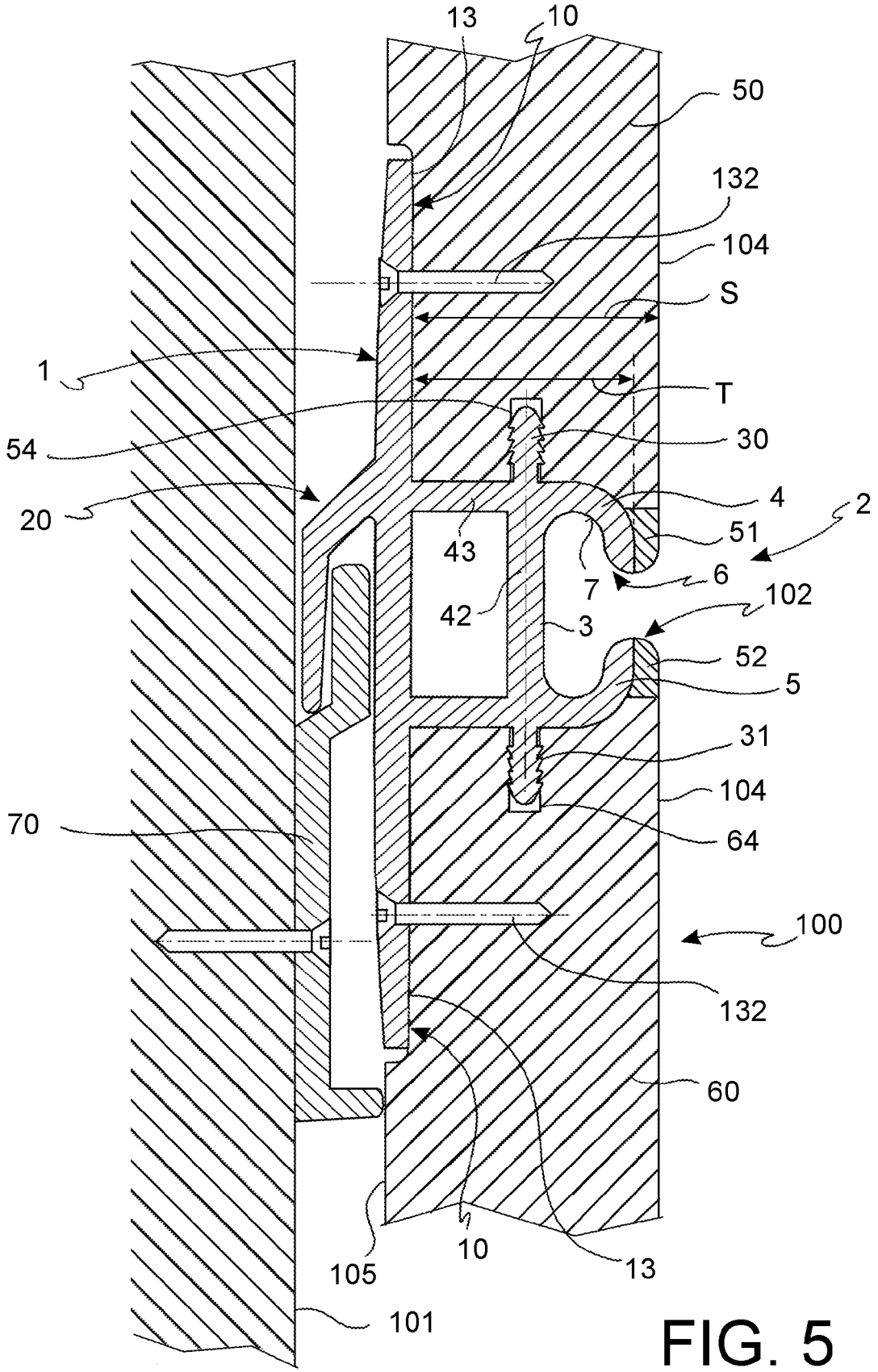
FIG. 5 shows a sectional view of a detail of fitted panel comprising a profile according to the invention, mounted to a wall.
Figure 6:
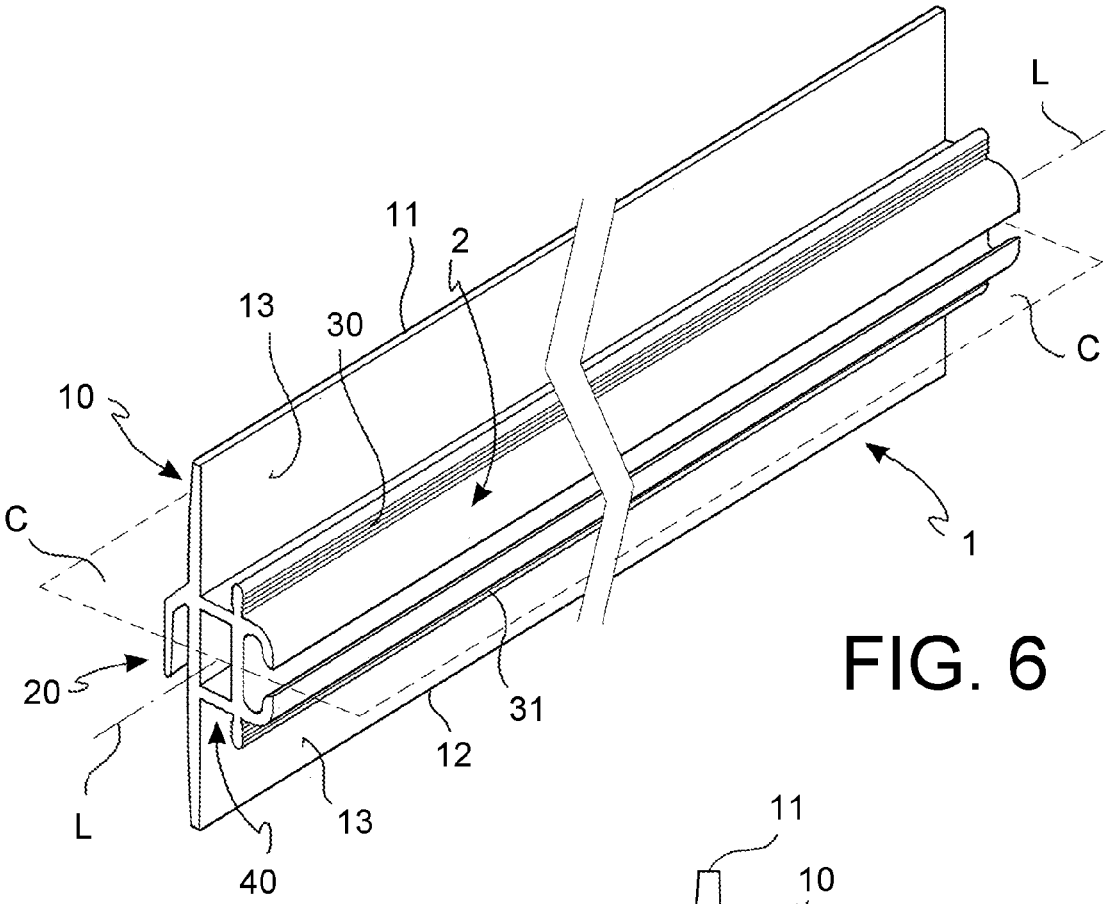
FIG. 6 shows a perspective view of a profile according to the invention.
Figure 7:
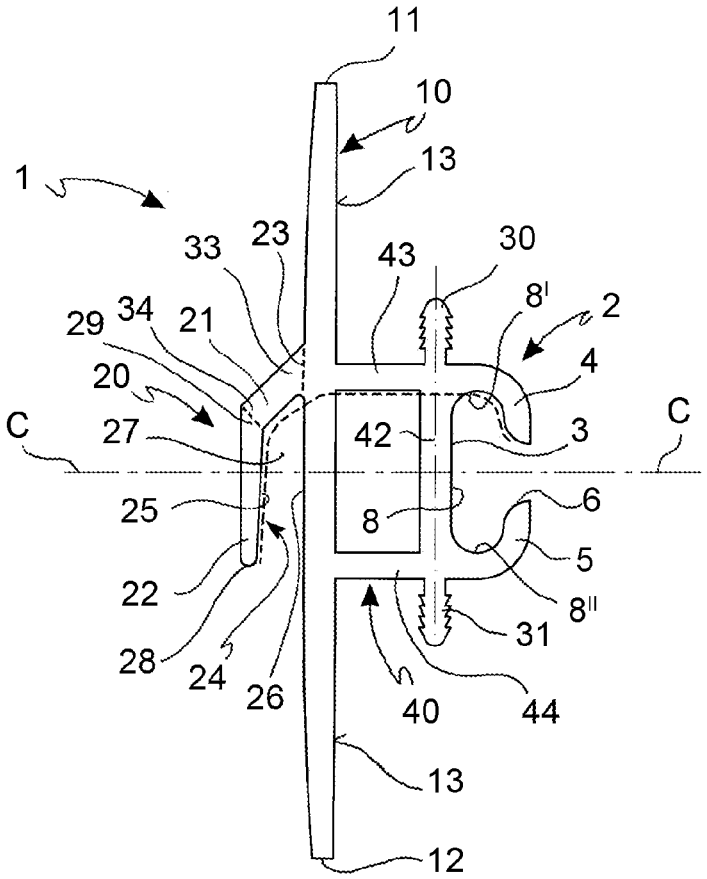
FIG. 7 shows a sectional view of the profile in FIG. 6.

Below, reference will be made to "longitudinal direction" to indicate an extrusion direction of the profile. In other words, the profile is defined by the translation of its section orthogonal to the longitudinal direction along the longitudinal direction.

"Longitudinal plane" means a plane parallel to the longitudinal direction.

"Orthogonal section" means a cross-section of the profile with a section plane orthogonal to the longitudinal direction.

With reference to the figures, an extruded profile according to the invention is generally designated by reference numeral 1.

The extruded connection profile is configured for connecting to each other an upper portion 50 and a lower portion 60 of a fitted panel 100 suitable to be hung on a wall 101 and comprising a panel slot 102.

Such a profile is made in one piece, avoiding to be made in two or more separate portions coupled together.

Such a profile 1 defines a longitudinal direction L-L and comprises a plate portion 10 delimited by an abutment surface 13 and by an upper edge 11 parallel to the longitudinal direction and by a lower edge 12 parallel to the upper edge 11. According to an embodiment, the abutment surface 13 is flat.

Profile 1 further comprises a coupling portion 2 which extends transversely from the abutment surface 13, said coupling portion 2 comprising a longitudinal channel 6 laterally defined by at least one lip undercut 4, 5 which projects towards the inside of the longitudinal channel 3.

The longitudinal channel 6 of the coupling portion 2 is adapted to form in use said panel slot 102.

According to an embodiment, the coupling portion 2 extends in a plane orthogonal to the abutment surface 13.

According to an embodiment, the longitudinal channel is defined by an upper lip undercut 4 and by a lower lip undercut 5.

In this case, the upper lip 4 and the lower lip 5 extend towards each other, towards the interior of the channel.

The upper lip 4 and the lower lip 5 together with the channel define an inner curved surface 7 of the channel. In particular, the inner surface 7 has an upper concave portion 8' facing a lower concave portion 8", in which the upper concave portion 8' is connected to the lower concave portion 8" by means of a flat bottom portion 8. In other words, the coupling portion 2, according to one embodiment, has a cross-section in the shape of a "C".

According to an embodiment, the profile 1 comprises an anchoring rib 20 to hang the panel 100 from a wall, said rib extending transversely from said plate portion 10, on the side opposite said coupling portion 2.

According to an embodiment, the anchoring rib 20 is connected to the plate portion 10 in a junction area 23 aligned with one of said at least one lip undercut 4, 5. According to an embodiment, the anchoring rib 20 extends alongside the plate portion 10 towards another of said at least one lip undercut 4, 5, for example parallel to the plate portion 10.

In this way, the forces applied to said lip undercut 4, 5 are transmitted directly to the anchoring rib 20, forming a continuous structure that can be solidly anchored to a wall so as to prevent rotation of the profile under the action of the own weight of the panel and of any wall cabinets hung to the extruded profile 1.

The set of anchoring rib 20 and of said lip undercut 4, 5 forms a continuous structure 24 substantially in the shape of a "C", wherein the free ends of such a structure 24 are formed by said anchoring rib 20 and said lip undercut 4, 5. In this way, the forces applied to said lip undercut 4, 5 are balanced by the reactions applied to the anchoring rib 20.

According to an embodiment, the anchoring rib 20 is connected to plate 10 in a junction area 23 aligned with the upper lip undercut 4. According to an embodiment, the anchoring rib extends alongside the plate portion 10 towards the lower lip undercut 5, for example parallel to the plate portion 10.

The anchoring rib 20 together with the upper lip undercut 4 forms a continuous structure 24 in the shape of a "C", wherein the free ends of such a continuous structure 24 are formed by the anchoring rib 20 and by the upper lip undercut 4. Such a continuous structure 24 may be operatively arranged with the free ends facing downwards.

In this way, the forces applied to the upper lip undercut 4 are balanced by the reaction forces applied to the anchoring rib 20 by wall 101 to which panel 100 is hung.

According to an embodiment, the anchoring rib 20 defines an inner surface 25 of anchoring rib 20 facing said plate portion 10 and the plate portion defines a rear surface of plate 26 facing said inner surface, wherein said the inner surface 25 and said rear surface 26 define an anchoring channel 27, for example in the shape of a "U". Said anchoring channel is adapted for anchoring to the anchoring means 70 secured to wall 101.

According to an embodiment, the anchoring rib 20 comprises an attachment portion 21 which extends transversely to the plate portion 10, and an end portion 22 which extends alongside the plate portion 10, for example substantially parallel to the plate portion 10.

According to an embodiment, the end portion 22 has a free end 28 and an opposite connection end 29 connected to said attachment portion 21.

The attachment portion 21 has a first end 33 connected to the plate portion 10 at the junction portion 23, and a second end 34, opposite the first end, connected to the connection end 29.

The attachment portion 21 is connected to the plate portion 10 in a junction area 23 aligned with one of said at least one lip undercut 4, 5, for example, the attachment portion 21 is connected to the plate portion 10 in a junction area 23 aligned with the upper lip undercut 4. According to an embodiment, the end portion 22 extends substantially parallel to the plate portion 10 towards the lower lip undercut 5.

According to an embodiment, the end portion 22 is substantially flat. For example, the end portion is tapered towards the free end 28.

According to an embodiment, the attachment portion 21 is substantially flat, for example, the attachment portion 21 extends along a plane inclined with respect to the plate portion 10.

According to an embodiment, the attachment portion 21 extends along a plane inclined with respect to the plate portion 10 from the junction area 23 towards another of said at least one lip undercut 4, 5, away from the plate portion 10, from the side opposite the coupling portion 2.

According to an embodiment, the attachment portion 21 extends along a plane inclined with respect to the plate portion 10, from the junction area 23 towards the lower lip undercut 5, away from the plate portion 10, from the side opposite the coupling portion 2.

According to an embodiment, the profile comprises at least one attachment rib 30, 31 for attaching the profile 1 to the upper 50 and lower portions 60 of the fitted panel 100, said attachment rib 30, 31 extending laterally in relation to said coupling portion 2 and parallel to said plate portion 10.

In particular, profile 1 comprises an upper attachment rib 30 for the attachment to the upper portion of the panel 50 and an opposite lower attachment rib 31 for the attachment to a lower portion of the panel 60.

According to an embodiment, the upper attachment rib is coplanar with the lower attachment rib along a plane parallel to an extension plane of the panel, or to a plane parallel to the abutment surface 13, or to a plane perpendicular to a center plane C-C.

The upper attachment rib 30, according to an embodiment, extends from the coupling portion 2 on the opposite side with respect to the lower attachment rib 31.

According to an embodiment, the upper attachment rib 30 is adapted to be housed in, and to engage by interference with, a corresponding upper longitudinal groove 54 formed in a longitudinal side of the upper portion of the panel 50.

According to an embodiment, the lower attachment rib 31 is adapted to be housed in, and to engage by interference with, a corresponding lower longitudinal groove 64 formed in a longitudinal side of the lower portion of the panel 60.

According to an embodiment, the upper attachment rib 30 and the lower attachment rib 31 have a lateral surface with projections to facilitate the attachment of the profile to the upper portion of the panel 50 and to the lower portion of the panel 60.

According to an embodiment, the profile 1 comprises a box-shaped portion 40 interposed between the coupling portion 2 and the plate portion 10.

Such a box-shaped portion has the purpose of arranging the coupling portion 2 at a distance from the plate portion such as to position such a coupling portion within the thickness of panel 100.

According to an embodiment, the box-shaped portion 40 comprises an upper wall 43 which extends transversely to the plate portion 10, from the plate portion to the upper lip undercut 4.

According to an embodiment, the box-shaped portion 40 comprises a lower wall 44 which extends transversely to the plate portion 10 from the plate portion 10 to the lower lip undercut 5.

According to an embodiment, the box-shaped portion 40 comprises a side wall 42 which connects the upper wall 43 and the lower wall 44 to each other.

According to an embodiment, the box-shaped portion 40 is formed by the plate portion 10, the upper wall 43 transverse to the plate portion 10, the lower wall transverse to the plate portion 10, the side wall 42 which connects the upper wall 43 and the bottom wall 44 to each other. In other words, the box-shaped portion 40 is for example a closed box-shaped portion, for example having rectangular cross-section.

For example, the upper wall 43 is orthogonal to the plate portion 10, for example the upper wall 43 and the side wall 42 are orthogonal to each other, for example the upper wall 43 and the lower wall 44 are parallel to each other.

In other words, the upper wall is orthogonal to the abutment surface 13 and/or the lower wall 44 is perpendicular to the abutment surface 13.

According to an embodiment, the anchoring portion 20 extends from the plate portion 10 at the upper wall 43 of the box-shaped portion 40.

According to an embodiment, the upper lip undercut 4 extends from said upper wall 43 as an extension of said upper wall 43 on the side opposite to said anchoring rib 20 and aligned with said junction area 23.

In this way, the upper lip undercut 4, the upper wall 43 and the anchoring rib 20 form a continuous structure 24 substantially in the shape of a "C". In this way, the forces applied to the upper lip undercut 4 are balanced by the reaction forces applied to the anchoring rib 20 through the interposed upper wall 43.

According to an embodiment, the lower lip undercut 5 extends from said lower wall 44 as an extension of said lower wall on the side opposite to said anchoring rib 20.

According to an embodiment, the upper attachment rib 30 and the lower attachment rib 31 are aligned with each other on a plane parallel to the abutment surface 13, or to a plane of extension of the panel, for example the upper attachment rib 30 and the lower attachment rib 31 are aligned with each other and also with the side wall 42 of the box-shaped portion 40. This gives a structural high stiffness to the connection between the upper portion of the panel 50 and the lower portion of the panel 60.

Profile 1 remains in use within the thickness of panel 100 by the length that goes from the abutment surface 13 up to the opposite end of the coupling portion 2.

According to an embodiment, the coupling portion 2 extends along a central plane C-C perpendicular to the abutment surface 13 and equidistant from the upper edge 11 and from the lower edge 12.

According to an embodiment, the anchoring rib 20 is aligned with said coupling portion 2 along the central plane C-C.

In other words, profile 1 has the anchoring portion 20, the plate portion 10, the box-shaped portion 40 and the coupling portion 2, all aligned up in a sequence on a same plane, in particular they are aligned in a sequence on the central plane C-C.

According to an embodiment, the profile 1 has a symmetrical shape with respect to the central plane C-C, apart from said anchoring rib 20.

According to another aspect of the present invention, the above objects and advantages are met by a fitted panel 100 suitable to be hung from a wall 101, comprising an upper portion of the panel 50 and a lower portion of panel 60, said panel comprising a panel slot 102 interposed between said upper portion of the panel 50 and said lower portion of the panel 60, said panel slot 102 being suitable to engage and support a support bracket 103, 103' for a component hanging from said panel, said panel 100 having a rear side 105 suitable to face the wall 101, and a front side 104 opposite the rear side 105.

The fitted panel 100 includes at least one extruded connection profile 1 for connecting said upper portion 50 and said lower portion 60 to each other, having one or more of the features described above, in any combination.

Such a profile comprises a plate portion 10 delimited by an abutment surface 13 placed in abutment with the rear side 105 of the panel, and by an upper profile edge 11 parallel to the longitudinal direction and by a lower profile edge 12 parallel to the upper edge of the profile 11.

Such a profile comprises a coupling portion 2 which extends transversely from said abutment surface 13, said coupling portion 2 comprising a longitudinal channel 3 facing said front side 104 at said panel slot 102, said channel being delimited laterally by at least one lip undercut 4, 5 projecting towards the inside of the longitudinal channel 3.

Such a profile comprises an anchoring rib 20 to hang panel 1 to a wall, said rib extending transversely from said plate portion 10, on the side opposite said coupling portion 2.

According to an embodiment, the dimension of the overall extension T, or encumbrance, of the coupling portion 2 from the abutment surface 13 of the profile 1 measured in an orthogonal direction to the abutment surface 13 is less than the thickness of the upper portion of the panel 50 and of the thickness of the lower portion of the panel 60 at said panel slot 102.

In other words, distance S between the front side 104 of panel 100 and the abutment surface 13 measured in a direction orthogonal to the abutment surface 13, is greater than distance T between a maximum free end of the coupling portion 2 and the abutment surface 13 measured in a direction orthogonal to the abutment surface 13.

Distance T between a maximum free end of the coupling portion 2 and the abutment surface 13 measured in a direction orthogonal to the abutment surface 13 also refers to the maximum encumbrance of the coupling portion 2 measured from the abutment surface 13 in a direction orthogonal to the abutment surface 13.

According to an embodiment, the fitted panel 100 comprises a finishing and reinforcement strip 51, 52 for each lip 4, 5 suitable to connect in a continuous shape by means of a curved surface, an inner surface 7 of channel 6 with the front side of the fitted panel 100.

According to an embodiment, panel 100 comprises further attachment elements to attach the profile to the upper portion of the panel 50 and to the lower portion of the panel 60. For example, such attachment elements are screws 132 passing through the plate portion 10.

According to an embodiment, the extruded profile 1 is made of aluminum, or aluminum alloy.

According to an embodiment, the upper portion of the panel 50 and the lower portion of the panel 60 are made of wood or plywood, or laminate.

According to an embodiment, the finishing and reinforcement strips 51, 52 are made of wood.

According to an embodiment, the upper portion of the panel 50 and the lower portion of the panel 60 are covered with a wooden plate.

A man skilled in the art may make several changes, adjustments, adaptations and replacements of elements with other functionally equivalent ones to the embodiments of the device described above in order to meet incidental needs, without departing from the scope of the following claims. Each of the features described as belonging to a possible embodiment can be obtained independently of the other embodiments described.

The invention claimed is:

1. Extruded connection profile for connecting to each other an upper portion and a lower portion of a fitted panel, said fitted panel being configured to be hung on a wall, said panel comprising a panel slot interposed between the upper portion and the lower portion and configured for receiving and hooking an object hanging on said panel from said panel slot, said profile defining a longitudinal direction and comprising:

a plate portion defined by an abutment surface, by an upper edge parallel to the longitudinal direction, and by an opposite lower edge parallel to the upper edge;

a hooking portion which extends transversely from said abutment surface in a plane orthogonal to the abutment surface, said hooking portion comprising a longitudinal channel configured to form in use said panel slot there within, and configured for receiving and hooking a support bracket for supporting the object hanging on said panel from said panel slot, the longitudinal channel being defined laterally by at least one arcuate lip undercut of at least one lip which projects towards the inside of the longitudinal channel;

an anchoring rib to hang the panel to a wall, said anchoring rib extending transversely from said plate portion, from a side of the plate portion opposite to said hooking portion;

wherein the extruded connection profile is formed in one piece.

2. Profile according to claim 1, wherein the anchoring rib is connected to the plate portion in a junction area aligned with one of said at least one lip undercut, said anchoring rib extending alongside said plate portion towards another of said at least one lip undercut.

3. Profile according to claim 1, wherein said anchoring rib and said lip undercut together form a continuous structure substantially in the shape of a "C", wherein the free ends of such a continuous structure are formed by said anchoring rib and said lip undercut.

4. Profile according to claim 1, comprising at least one attachment rib for attaching the profile to at least one of the upper or lower portions of the fitted panel, said attachment rib extending laterally in relation to said hooking portion and parallel to said plate portion.

5. Profile according to at least one preceding claim, comprising a box-shaped portion interposed between the hooking portion and the plate portion, said box-shaped portion comprising an upper wall which extends starting from the plate portion in a direction transversely incident to the abutment surface of the plate portion.

6. Profile according to claim 5, wherein an upper lip undercut of said at least one lip undercut extends from one end of said upper wall as an extension of said upper wall, and wherein the anchoring rib extends from the plate portion aligned with the upper wall of the box-shaped portion.

7. Profile according to claim 5, wherein the upper lip undercut, the upper wall and the anchoring rib together form a continuous structure substantially in the shape of a "C".

8. Profile according to claim 1, wherein the hooking portion extends along a central plane perpendicular to the abutment surface and equidistant from the upper edge and from the lower edge.

9. Profile according to claim 8, wherein the anchoring rib is aligned with said hooking portion along the central plane.

10. Profile according to claim 8, wherein said profile has a symmetrical shape with respect to the central plane, apart from said anchoring rib.

11. Profile according to claim 1, wherein an upper lip and a lower lip together with the channel define an inner curved surface of the channel and extend toward each other and towards the interior of the channel.

12. Profile according to claim 1, wherein the inner surface has an upper concave portion facing a lower concave portion in which the upper concave portion is connected to the lower concave portion by means of a flat bottom portion.

13. Fitted panel configured to be hung from a wall, comprising an upper portion of the panel and a lower portion of the panel, said panel comprising a panel slot interposed between said upper portion of the panel and said lower portion of the panel, said panel slot being configured to receive, engage and support a support bracket for an object hanging from said panel, said panel having a rear side configured to face the wall, and a front side opposite the rear side;

comprising:

an extruded connection profile for connecting said upper portion and said lower portion to each other, said profile defining a longitudinal direction and comprising:

a plate portion defined by an abutment surface placed in abutment with the rear side of the panel, and by an upper profile edge parallel to the longitudinal direction and by a lower profile edge parallel to the upper edge of the profile;

a hooking portion which extends transversely from said abutment surface in a plane orthogonal to the abutment surface, said hooking portion comprising a longitudinal channel configured to form in use said panel slot there within, and configured for receiving and hooking a support bracket for supporting the object hanging on said panel from said panel slot, the longitudinal channel being defined laterally by at least one arcuate lip undercut of at least one lip projecting towards the inside of the longitudinal channel;

an anchoring rib to hang the panel to a wall, said rib extending transversely from said plate portion, on the side opposite said hooking portion.

14. Fitted panel according to claim 13, wherein the dimension of the overall extension of the hooking portion from the abutment surface of the profile measured in an orthogonal direction to the abutment surface is less than the thickness of the upper portion of the panel and of the thickness of the lower portion of the panel at said panel slot.

15. Fitted panel according to claim 13, wherein the distance between the front side of the panel and the abutment surface measured in a direction orthogonal to the abutment surface, is greater than the distance between a maximum free end of the hooking portion and the abutment surface measured in a direction orthogonal to the abutment surface.

16. Fitted panel according to claim 13, comprising a finishing and reinforcement strip for the at least one lip configured to connect in a continuous shape by means of a curved surface, an inner surface of the channel with the front side of the fitted panel.

* * * * *